US009512722B2

(12) United States Patent
Bitondo et al.

(10) Patent No.: US 9,512,722 B2
(45) Date of Patent: Dec. 6, 2016

(54) AEROFOIL COMPONENT HANDLING TOOL

(71) Applicant: ROLLS-ROYCE PLC, London (GB)

(72) Inventors: Donato Bitondo, Derby (GB); Mark Bartlam, Stafford (GB); Marcel Ernesto Leon De Paz, Derby (GB); Peter Macrae, Edinburgh (GB)

(73) Assignee: ROLLS-ROYCE plc, London (GB)

( * ) Notice: Subject to any disclaimer, the term of this patent is extended or adjusted under 35 U.S.C. 154(b) by 207 days.

(21) Appl. No.: 14/330,620

(22) Filed: Jul. 14, 2014

(65) Prior Publication Data

US 2015/0033560 A1 Feb. 5, 2015

(30) Foreign Application Priority Data

Jul. 30, 2013 (GB) ..... 1313534.8

(51) Int. Cl.

| | |
|---|---|
| ***B66F 7/06*** | (2006.01) |
| ***F01D 5/00*** | (2006.01) |
| ***B25B 5/06*** | (2006.01) |
| ***B25B 5/14*** | (2006.01) |
| ***F01D 25/28*** | (2006.01) |

(52) U.S. Cl.

CPC ..... *F01D 5/005* (2013.01); *B25B 5/068* (2013.01); *B25B 5/14* (2013.01); *F01D 25/285* (2013.01); *F05D 2260/83* (2013.01); *Y10T 29/49318* (2015.01); *Y10T 29/53991* (2015.01)

(58) Field of Classification Search

CPC ..... B25B 27/00; B25B 27/02; B25B 29/00; B25B 33/00

See application file for complete search history.

(56) References Cited

U.S. PATENT DOCUMENTS

| | | | |
|---|---|---|---|
| 2,128,268 | A | 8/1938 | Small et al. |
| 4,096,614 | A | 6/1978 | Brungard et al. |

(Continued)

FOREIGN PATENT DOCUMENTS

| | | | |
|---|---|---|---|
| BE | 334 452 | A | 5/1926 |
| CN | 202607547 | U | 12/2012 |

(Continued)

OTHER PUBLICATIONS

Jun. 19, 2015 Search Report issued in European Patent Application No. 14 17 6855.

(Continued)

*Primary Examiner* — Lee D Wilson
(74) *Attorney, Agent, or Firm* — Oliff PLC

(57) ABSTRACT

A handheld tool facilitates the removal of an aerofoil from an array of aerofoils for an axial flow machine includes a body portion, and first and second jaw members depending from the body portion. The first jaw member is shaped to be insertable between a first aerofoil and an adjacent aerofoil in the array so as to contact a first surface of the first aerofoil. The position of the first and/or second jaw member is adjustable to selectively grip the aerofoil in use. The second jaw member is adapted to contact a further portion as a trailing edge of the first aerofoil. The tool may allow for manual levering and/or impact forces to be applied to the aerofoil. A method of removal of aerofoils is also provided, involving a sequence of manual operations using the tool. The aerofoil array may be a stator vane array for a gas turbine engine.

14 Claims, 4 Drawing Sheets

(56) References Cited

U.S. PATENT DOCUMENTS

| | | | | |
|---|---|---|---|---|
| 5,096,170 | A * | 3/1992 | Albin | B25B 5/068 269/203 |
| 5,845,354 | A * | 12/1998 | Long | B25B 5/068 7/139 |
| 8,381,379 | B2 | 2/2013 | Holmes et al. | |
| 8,833,747 | B2 * | 9/2014 | Cusumano | B25B 5/003 269/143 |
| 2010/0263183 | A1 | 10/2010 | Holmes et al. | |
| 2014/0265085 | A1 * | 9/2014 | Albin | B25B 5/127 269/6 |
| 2015/0033560 | A1 * | 2/2015 | Bitondo | F01D 5/005 29/889.1 |

FOREIGN PATENT DOCUMENTS

| | | |
|---|---|---|
| EP | 0 013 772 A1 | 8/1980 |
| EP | 2 169 184 A2 | 3/2010 |
| EP | 1 806 477 A3 | 9/2010 |

OTHER PUBLICATIONS

United Kingdom Search Report issued in United Kingdom Application No. GB1313534.8 issued Nov. 13, 2013.

* cited by examiner

AEROFOIL COMPONENT HANDLING TOOL

BACKGROUND OF THE INVENTION

The present invention relates to axial flow machine assembly/disassembly tools and methods and, in particular, to tools for handling components, such as aerofoils, for overhaul and maintenance of axial flow machines.

In an axial flow machine, a fluid flow is directed along a course that is substantially parallel to an axis of rotation of the machine. An axial flow machine, such as a compressor, impeller, turbine or the like, may form a sub-assembly of a larger machine. The compressor of an axial flow engine is one example of such a machine and typically comprises several axially-aligned stages, with each stage designed to increase the pressure of the airflow passing therethrough. A conventional compressor may thus comprise successive arrays, often referred to as 'rows', of aerofoils, typically arranged as successive arrays of rotor blades with each rotor array being spaced by an intermediate array of stator vanes. The purpose of the stator arrays of aerofoils is to redirect the airflow either before or after passage through the rotator array, thereby influencing both the direction and pressure of the airflow through the compressor.

Stator arrays of aerofoils are commonly attached to the casing of the compressor, often via a common channel in the casing. Over time, and with prolonged use, aerofoils in such an array have the potential to become damaged, or otherwise need to be removed and/or replaced.

The removal of individual aerofoils from an array is a critical process in the overhaul of a gas turbine engine. As such there is a need for the process to be as streamlined and efficient as possible.

The conventional aerofoil removal process involves sliding each stator aerofoil in turn along the channel in the casing so as to remove the aerofoil from an open end of the channel. However, due to the high operating temperatures of an axial flow engine and the loading on the aerofoils in use it is possible for aerofoils to become distorted and/or slightly misaligned over time, and this can result in the aerofoils becoming stuck or jammed in their position in the casing channel. This is a particular problem due the high tolerance required between the stators and the channel. As such the force required to loosen and remove an aerofoil is increased.

A basic process for the removal of aerofoils from an axial flow engine involves attempting to loosen the aerofoil by striking it with a hammer or mallet, and then simply prying the aerofoil free by hand. The force provided by the combination of a hammer or mallet and prying the aerofoil by hand is often insufficient to remove the aerofoil. This process may need to be repeated a plurality of times, typically using varying impact forces each time, thereby making the process as a whole time-consuming and potentially causing damage to the aerofoils and/or the casing.

Furthermore, due to the variable condition that each aerofoil may be found in, each aerofoil may need to be treated differently. As such some aerofoils may have been removed with minimal force whereas other aerofoils in the same array may have undergone significant impact forces. Furthermore, the success of the entire procedure can often also depend on the experience of the fitter tasked with carrying out the procedure. Such variations in both success rate and impact forces applied are clearly undesirable for a critical process in the overhaul of a gas turbine engine.

There have been several attempts to provide alternative tools and/or systems for carrying out a stator removal procedure such that the removal process can be better controlled. Examples of such tools are disclosed in EP2169184, U.S. Pat. No. 4,096,614, and U.S. Pat. No. 8,381,379. However each of these tools has been found to have associated problems. Such tools represent large systems for accommodating the entire array and have a drive mechanism for applying force to one or more stator in a predetermined (i.e. circumferential) direction. Such complex systems are therefore difficult for a fitter to use with any real accuracy. Such tools often require that an excessive level of force is applied to remove an aerofoil from its position, and this can potentially cause damage to the aerofoil and/or casing, as well as creating potentially hazardous situations for the fitter. Furthermore, the large scale of such tools can also mean that they are expensive to manufacture.

It is an aim of the invention to provide a tool for which one or more of the problems discussed above is at least partially mitigated. It may be considered a further aim to provide a tool that can better accommodate removal of individual aerofoils from an array in a more controlled manner.

BRIEF SUMMARY OF THE INVENTION

According to a first aspect of the invention there is provided a handheld tool adapted to facilitate the removal of an aerofoil from an array of aerofoils for an axial flow machine, the tool comprising a body portion, and first and second jaw members depending from the body portion, wherein the first jaw member is shaped to be insertable between a first aerofoil and an adjacent aerofoil in the array so as to contact a first portion of the first aerofoil, and the second jaw member is adapted to contact a further portion of the first aerofoil, the position of the first and/or second jaw member being adjustable to selectively grip the first aerofoil therebetween in use.

The first jaw member may comprise a substantially flat inner surface. The first jaw member may comprise a curved inner surface. Alternatively the first jaw member may comprise an inner surface that conforms substantially to the shape of the aerofoil.

The first jaw member may have a length or height that is substantially the same as the chord length of the first aerofoil. Alternatively, the first jaw member may have a length that is longer than the chord length of the first aerofoil.

The first jaw member may or may not be located at a distal end of the body portion of the handheld tool. The first jaw member may be fixed relative to the body portion. Alternatively, both the first and second jaw members may be adjustable. Adjustment means may be provided for the first and/or second jaw member, such as a screw thread, slider, or similar arrangement.

The tool may be self-supporting on the first aerofoil once it is gripped between the first and second jaw members.

The second jaw member may be of a shorter length than the first jaw member. The second jaw member may be of a length that is substantially less than the chord length of the first aerofoil. Alternatively, the second jaw member may be of substantially the same length as the first jaw member.

The second jaw member may comprise an inner surface that is substantially parallel to the inner surface of the first jaw member. The second jaw member may comprise a substantially flat inner surface. The second jaw member may comprise a curved inner surface. The second jaw member may comprise an inner surface that conforms substantially to the shape of the aerofoil.

The second jaw member may be located part way between proximal and distal ends of the body portion of the handheld tool.

The position of the second jaw member may be adjustable relative to the position of the first jaw member. The second jaw member may be provided with a lockable formation, so as to selectively disable movement of the second jaw member when in use. The lockable formation may take the form of a pin or other latching member.

The body portion of the handheld tool may extend beyond the second jaw member (for example, in a direction away from the first and second jaw members), for example towards a user when the tool is in use. A first body portion may extend between the first and second jaw members and a second body portion may extend beyond the first or second jaw member. The second body portion may provide a lever or cantilever formation, such as a levering arm. The levering arm may be used to facilitate the removal of aerofoils.

The body portion of the handheld tool may have substantially the same width as the first and second jaw members. Alternatively the body portion may have a width that is longer than the width of the first and second jaw members. Any, any combination, or all, of the body portion, the first jaw member and/or second jaw member may have a width dimension that is at least 10% or 20% of the span of the first aerofoil. The width dimension may extend across a majority of the span of the aerofoil in use. Accordingly, when the aerofoil is gripped between the jaw members any load applied to the tool is spread evenly over a significant portion of the aerofoil span.

The body portion may have a substantially cuboidal cross section.

The body portion and/or first jaw member may be provided with an impact formation, for example at the distal end of the body portion. Alternatively, an impact formation may be located in a central region of the body portion. The impact formation may be raised or upstanding relative to the surface of the body portion or jaw member. The impact formation may be strengthened relative to the remainder of the body portion or jaw member, for example being of greater wall thickness or depth. The upstanding impact formation may be contacted by a mallet or hammer when in use, such that an impact force and/or vibrations can be transferred from the upstanding impact formation to the rest of the tool, and hence to the aerofoil between the jaw members. This shocking or jolting action allows a jammed aerofoil to be dislodged in a controlled manner and may thus facilitate the removal of the aerofoil from the array.

The upstanding impact formation may be substantially cuboidal in cross section and/or circular in plan. The upstanding impact formation may have a width that is substantially the same as the body portion of the tool.

The body portion may be provided with a measurement scale, such that the relative position of the jaw members may be indicated.

The body portion of the tool may be at least partially hollow. In one example only the proximal end of the body portion may be hollow whereas the distal end of the body portion may be solid.

The proximal end of the body portion may be provided with a screw thread arrangement.

In one embodiment, the body portion comprises a handle, typically spaced from the first and second jaw members. The handle is preferably arranged to allow application of a tensile force in the body member, for example in a longitudinal direction of the body member and/or substantially perpendicular to the first jaw member. The handle may be spaced form the first jaw member by the second jaw member. The handle may extend in a direction that is substantially perpendicular to the direction of spacing and/or relative movement between the first and second jaw members. The handle may take the form of a closed loop.

The handle may depend from the proximal end of the body portion, e.g. towards a user when the tool is in use. The handle may have a circular or rounded cross section, so as to facilitate grasping of the handle. The surface of the handle may be contoured and/or provided with a non-slip material to improve grip.

The handle may comprise a first handle, which may be rigidly attached to, or integral with, the body portion.

A second handle or grip portion may be provided, which may be adjustable relative to the body portion and/or first handle. The second handle may be selectively lockable. The second handle may depend from the proximal end of the body portion for example, towards a user when the tool is in use. A portion of the second handle may extend into a hollow section of the body portion. The second handle may be adjustable in a direction towards and away from the first handle, for example in a direction between the first handle and first jaw member. The second handle may be linearly slidable relative to the body portion and/or first handle.

The second handle may allow adjustment of the second jaw member. The second handle may be integral with, or rigidly connected to, the second jaw member.

The second handle may or may not depend from the proximal end of the body portion, for example within the perimeter of the first handle. The second handle may sit between the body portion of the tool and the first handle. That is to say, there may be a gap between an outer surface of the second handle and an inner surface of the first handle.

The second handle may be provided with a screw thread arrangement. The second handle may be adjustably engaged with a corresponding screw thread in the body portion.

A releasable lock or latch may be provided for selectively fixing the relative spacing between the first and second jaw members. The second handle may be locked into position so as to prevent movement of the second jaw member. The second handle may be provided with a release button, catch, latch, a tighten-able nut/bolt or other releasable locking means so as to selectively engage/disengage the second handle with the body portion.

The array of aerofoils may be a circumferential array, for example, a row of aerofoils arranged about a common axis, or part thereof. The aerofoils to be removed may be vanes. The aerofoils to be removed may be stator vanes.

The axial flow machine may be a compressor, turbine, impeller or engine. The axial flow machine may comprise an axial flow engine, such as a gas turbine engine.

The aerofoils may be attached to a common support structure, which may be curved in form. The support structure may be a casing arrangement of the axial flow machine. The aerofoils may be aligned within a recess or slot within the support structure.

Any, any combination, or all of the body portion, the first jaw member, the second jaw member and/or the tool may be formed of a polymer/plastic material. At least the aerofoil contacting portions of the tool may be formed of a polymer/plastic material. A thermoplastic material, such as nylon may be used. The jaw members and/or handle portion may be formed of a different material to that of the tool body portion. However, most preferably the tool is formed of a uniform material. This has the advantage of being able to transfer loading and/or vibrations effectively through the tool to the first aerofoil.

The first portion of the aerofoil may be a first surface, such as a suction surface of the aerofoil. The further portion of the aerofoil may be an opposing surface (for example, a pressure surface) and/or an opposing portion, such as the leading or trailing edge of the aerofoil. The second jaw member may be moved in a direction towards the opposing surface to engage aerofoil. In any embodiment, the first portion of the first aerofoil may face the further/opposing portion of the adjacent aerofoil in the array.

According to a second aspect of the invention there is provided a method for removing aerofoils from an array of aerofoils for an axial flow machine, the method comprising the steps of:

i. inserting a first jaw member of a handheld tool between a first aerofoil and an adjacent aerofoil in the array, such that the first jaw member contacts a first portion of the first aerofoil;

ii. adjusting the position of the first and/or second jaw member such that the second jaw member contacts a further portion of the aerofoil so as to grip the aerofoil between the first and second jaw members; and iii. applying a tensile force to the tool away from the first jaw member in order to remove the aerofoil from its position in the array.

The method may further comprise the step of realigning the aerofoil in the horizontal and/or lateral planes. The method may comprise applying a torque force about a longitudinal axis of the aerofoil via the tool, for example via a lever portion of the tool.

The method may further comprise the step of impacting a portion of the tool to dislodge the aerofoil from the array. The impacting may be carried out using the hammer or mallet to apply a force to the body portion or a fixed jaw member of the tool, for example to an upstanding formation of the body portion. Impact may be applied whilst a tensile force is applied, so as to facilitate the removal of the aerofoil.

The impacting and or pulling of the tool may be performed manually.

Steps i to iii may be repeated for each aerofoil of the array in turn. The invention provides a standardised but manual process for aerofoil removal which can thus accommodate the separate handling of each aerofoil whilst still allowing a process for controlling the forces applied to disassemble the array.

Any of the preferable features described above in relation to the first aspect may be applied to the second aspect of the invention.

DETAILED DESCRIPTION OF THE INVENTION

Figure 1:
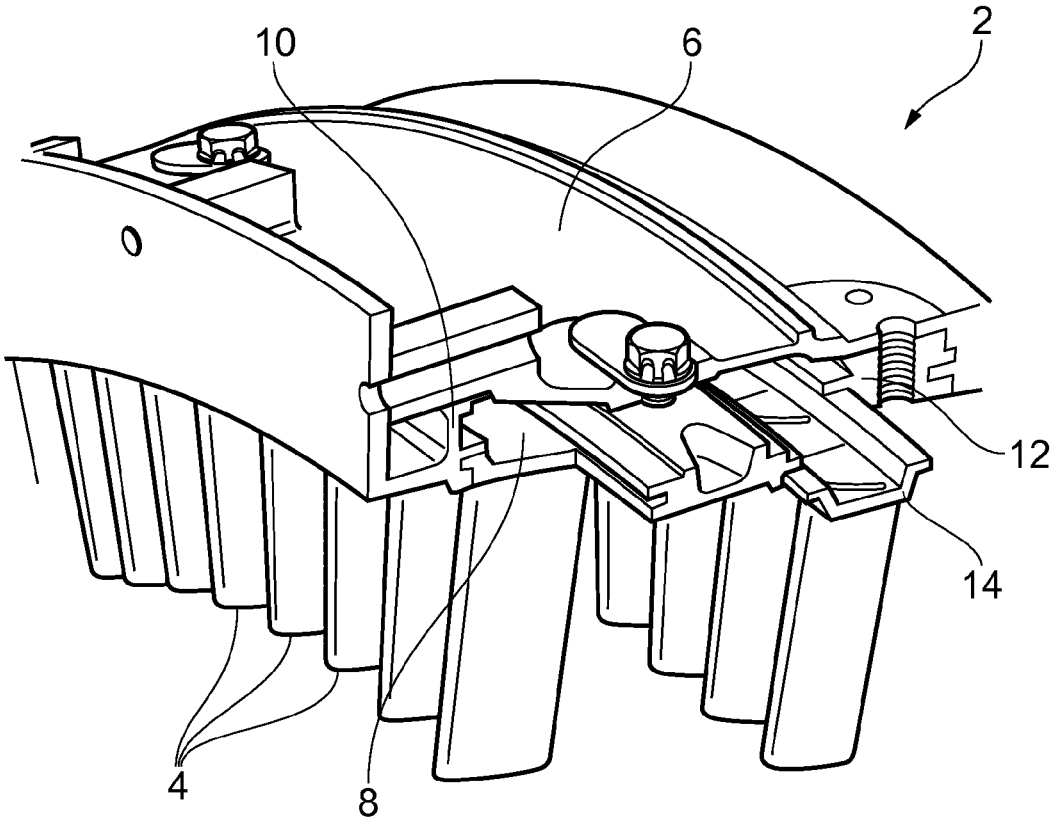
FIG. 1 (Prior Art)
FIG. 1 shows a partial perspective view of a conventional stator vane arrangement for a gas turbine engine.

Referring to FIG. 1, there is shown a portion of a conventional circumferential aerofoil array 2 for a gas turbine engine. The aerofoil array 2 in this example comprises a stator vane array for a compressor. The vanes 4 depend radially inwardly from a casing structure 6 to which the vanes are fixedly attached at their outer ends in use. In particular, the casing 6 is annular in shape and has an elongate recess or channel 8 therein. The channel is annular in form and is defined by opposing side walls 10, 12, which typically comprise a groove, lip or other retaining formation so as to define a slot for holding the vanes 4 securely within the recess (for example, in a radial direction).

In the example shown, two rows of vanes are provided in a fore and aft arrangement within the annular recess 8. The two rows are held in place by an intermediate retaining ring formation 10, thereby defining two channels within the recess 8. In alternative embodiments, a single channel or recess may be provided for each array of aerofoils. The casing 6 may accommodate a single or multiple compressor stages as necessary.

The stator vanes 4 each have a respective mounting formation 14 at an end thereof to be retained in the casing recess 8. When mounted for use, the mounting formations of adjacent vanes abut in a side-by-side arrangement.

Figure 2:
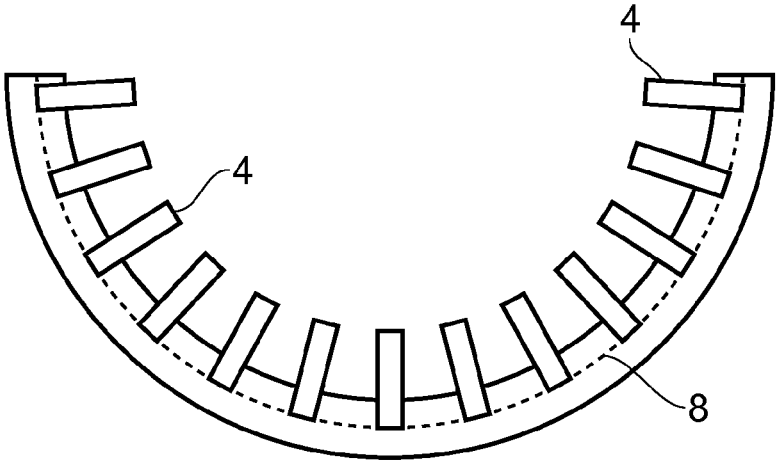
FIG. 2 (Prior Art)
FIG. 2 shows a schematic end view of a conventional half stator array.

As can be seen in FIG. 2, the vanes 4 depend substantially radially inwardly from the annular recess 8. In use the casing 6 forms a complete annulus such that the casing defines an outer wall of an annular flow passage. For assembly or removal of the vanes, the casing 6 can be split into a plurality, typically two, portions. Thus the annular recess 8 of each portion is open-ended to allow insertion and removal of vanes. The vane mounting formations 14 slide along the recess to/from the desired vane location.

Figure 3:
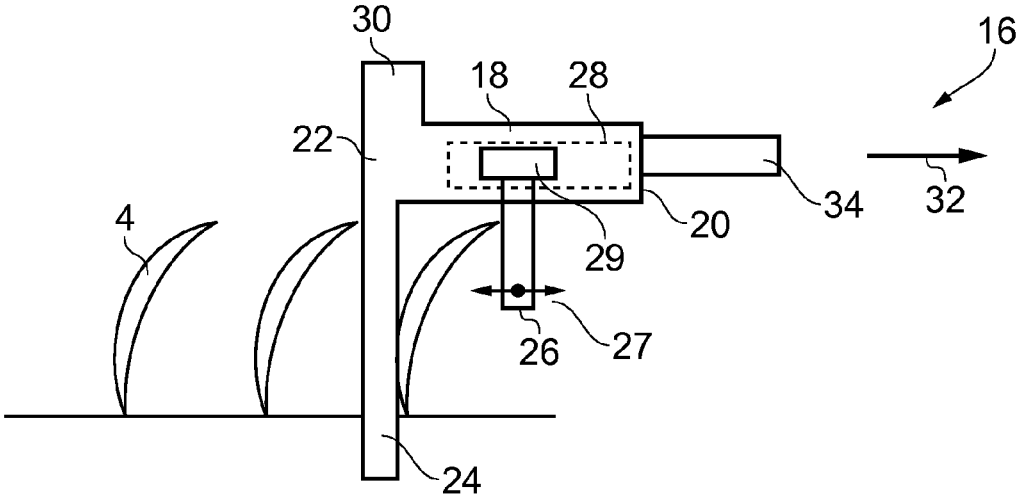
FIG. 3 shows a schematic side view of a tool according to an example of the invention when engaged with an aerofoil.
Figure 4:
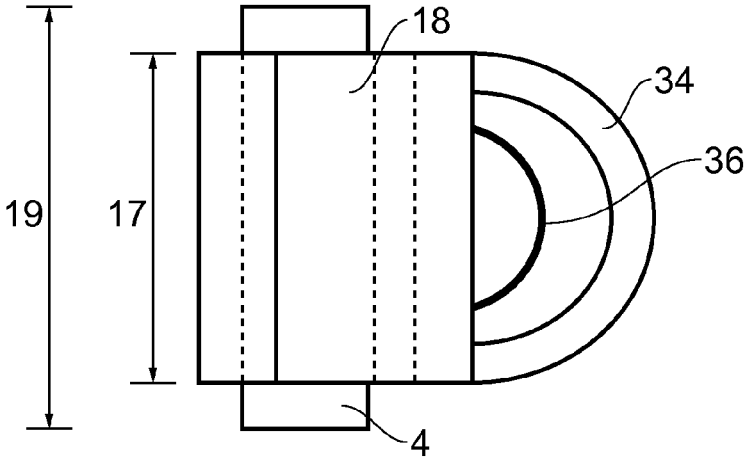
FIG. 4 shows a plan view of the tool of FIG. 3.

Turning now to FIG. 3, there is shown a handheld tool 16 adapted to facilitate the removal of an aerofoil from an array of aerofoils, such as the stator vane array 2 for an axial flow engine described above. The tool 16 comprises a body portion 18 that extends in a first direction. The body portion 18 comprises proximal 20 and distal 22 ends spaced in said first direction. A first jaw member 24 depends from the distal end 22 of the body portion 18, and extends away from the body portion in a second direction that is generally perpendicular to the first direction.

A second jaw member 26 depends from a mid portion of the body portion 18 at a location spaced from the distal end 22. The second jaw member 26 is thus spaced from the first jaw 24 in the first direction. Typically the second jaw member 26 is also spaced from the proximal end 20 in said direction. The second jaw member 26 is moveable back and forth along the body portion 18 in the first direction as indicated by arrows 27. In this regard the second jaw member 26 may be mounted in a slot or channel, such as an internal channel 28, within the body member. In such an arrangement, the second jaw member 26 may comprise a slider or runner formation 29 arranged to permit linear motion along the channel 28, whilst maintaining the second jaw 26 at the desired orientation, typically perpendicular to the first direction and/or parallel with the first jaw member.

In this example, the proximal end of the body member is hollow, thereby having an internal recess to accommodate the second jaw member and/or the associated slider 29. The slider is a close fit within the recess.

The body portion 18 extends beyond the second jaw member 26 towards a user when in use, for example, in a direction away from the first jaw member 24 or distal end 22, such that an overhang or cantilever arrangement of the body portion is formed. In contrast, the body portion 18 terminates at the first jaw member 24 at the distal end 22 of the tool. The overhung body portion defines a lever arm section, the function of which will be described below.

The body portion 18 has a substantially cuboidal cross section in this example.

The body portion 18 and/or jaw members have a width 17 that is at least 10% or 20% of the span 19 of the aerofoil 12. Preferably the width 17 extends over a majority of the span 19 of the aerofoil 19 and may be about 75% of the aerofoil span. The width 17 of the body portion 18 is preferably substantially the same as the widths 25,27 of the first 24 and second 26 jaw members. This allows the jaw members to maintain contact with the aerofoil along a significant proportion of its span. The width dimension may be greater than, for example, 1, 2, 5 or 10 cm depending on the size of the aerofoil to be removed.

The body portion 18 comprises an impact formation 30 at distal end 22. The impact formation 30 comprises a strengthened or reinforced region of the body so as to be able to withstand impact in one or more predetermined direction. In this example the impact formation 30 is an upstanding formation, thereby having an increased wall thickness or depth dimension as compared to the surrounding body portion. The upstanding nature of the formation is also beneficial in that it indicates a direction in which the formation is intended to be struck in use, which is typically in a direction towards an aerofoil held between the first and second jaw members. In this example the impact formation is upstanding in a direction extending away from the first and/or second jaw members. The formation is preferably on an opposite side of the body to the side from which the jaw members depend. The impact formation may be upstanding in a direction which is substantially parallel with the direction in which the first and or second jaw members extend (for example, perpendicular to the body portion surface).

The impact formation in this example takes the form of a nodule or protrusion but may additionally or alternatively be reinforced in other ways, such as by provision of a second, reinforcing material. In this example the upstanding impact formation 30 is elongate and extends across the width 17 of the body portion 18. This allows impact to be provided at multiple different places across the width of the tool 16 in use.

In some examples, the body portion 18 may also comprise a measurement scale, typically proximate to the second jaw member, which may facilitate the positioning of the first 24 and second 26 jaw members.

A first handle 34 depends from proximal end 20 of the body portion 18. The first handle 34 extends in a direction that is substantially parallel with the first and/or second jaw members. Thus, when gripped by a user, the handle allows a tensile force to be applied in a direction that is perpendicular to the direction in which the first jaw member extends, for example, in the direction of arrow 32 in FIG. 3.

The opposing ends of the first handle 34 are attached to the proximal end 20 of body portion 18 at spaced locations. The handle 34 may be integrally formed with the body portion as a single piece. In this example, the handle is generally hemispherical in plan and may be generally circular in cross section. The first handle 34 may comprise a non-slip substance and or grip formations as required.

A second handle 36 is provided to actuate the second jaw member 26. The second handle is operable by a user so as to cause a corresponding movement of the jaw member 26. The second handle 36 depends from the proximal end 20 of body portion 18 and may be contained within the perimeter of the first handle 34. In an embodiment as shown, in which the second handle 36 is generally hemispherical in shape, the hemisphere described by the second handle 36 has a smaller radius than that of the hemisphere described by the first handle 34. Thus the second handle 36 sits between the proximal end 20 of the body portion 18 and the first handle 34.

The second handle 36 is generally circular in cross section and may comprise a non-slip material and/or grip formations.

The second handle 36 extends into the hollow portion (for example, recess 28) of the body and is constrained to a one-dimensional, or sliding, motion. The second handle 36 is mechanically attached to the second jaw member 26 in both forward and reverse directions 27. The movement of the second handle 36 therefore actuates the second jaw member 26 towards and away from the first jaw member 24. The relative positions of the first and second handles allow significant manual force to be applied to grip an aerofoil in use.

The second handle 36 or jaw member 26 comprises a releasable locking formation or mechanism to selectively lock the second jaw member at a desired location relative to the first jaw member. This may be provided for example by a releasable threaded member that can be tightened against the slider 29 or handle or else a latching formation. Thus the jaws can be locked in position about an aerofoil in use.

Whilst the actuation of the second jaw in this example is achieved by a slidable handle 36, it will be appreciated that other mechanisms could be provided for more accurate and controlled adjustment, such as, for example: a threaded actuator that can be rotated to generate linear movement in the direction of the axis of rotation; a rack and pinion arrangement; or a lever arrangement.

The height dimension of second jaw member 26 is shorter than that of the first jaw member 24 in the example shown in FIG. 3. The tool will typically be bespoke to a known aerofoil array such that its dimensions are definable as being relative to those of the aerofoils or array.

The first jaw member 24 is shaped so as to be insertable between a first aerofoil 4 and an adjacent aerofoil in the array. The first jaw member is planar in form, taking the form of a wall, and has a wall thickness or depth dimension that is less than or substantially equal to the spacing between opposing surfaces of adjacent aerofoils in the array. The first jaw member 24 comprises a substantially flat inner contact surface but could otherwise be curved depending on the specific aerofoil array to be accommodated.

The first jaw member 24 has a height that is longer than the chord length of the aerofoil 4. The second jaw member 26 may be of a shape and dimensions equivalent to that of the first jaw member, although the height of the second jaw member may be reduced in light of the curved nature of the aerofoils 4, such that the second jaw member is only required to contact a leading or trailing edge on the pressure side of aerofoil 4.

The jaw members preferably comprise a material that is softer than that of the aerofoils 4. The contact surface of the jaw members or the jaw members, as a whole, may be formed of a polymer material. Nylon has been found to provide beneficial material properties for the purpose of the invention, although other similar materials may be suitable.

The body portion 18 and/or the tool as a whole may be substantially formed of a polymer material. The tool may be formed substantially uniformly of the same material, potentially with the exception of any fasteners or actuating/locking members.

The method of using the tool 10 is as follows, with reference to FIGS. 5A-5G. The first jaw member 24 is inserted into an array of aerofoils in a direction generally parallel with the first jaw member, between the first aerofoil 4A to be removed, and an adjacent aerofoil 4B in the array.

The inner surface of the first jaw member 24 thereby contacts the suction/convex surface of the first aerofoil 4A part way between the leading and trailing edge of the aerofoil.

The first jaw member is preferably a relatively close fit between the adjacent aerofoils 4A and 4B so that an outer surface of the first jaw member is proximate to, or in contact with, the opposing side of the adjacent aerofoil 4B at the same time as being in contact with the suction surface of the aerofoil 4A.

The second handle 36 is moved towards the distal end 22 of the body portion 18, so that the second jaw member 26 also slides towards the distal end 22 of the body portion 18, i.e. towards the first jaw member, in the direction of arrow 27. The second jaw member contacts the pressure/concave side of the aerofoil 4A at an edge thereof (the trailing edge 38 in this example). A clamping force can be applied between the first and second jaws by pushing the second handle 36 away from the first handle 34, or by use of any other suitable actuation mechanism as described above.

The second jaw member 26 is locked in place with the aerofoil 4A being held between the jaw members under compression. The tool 16 is typically self-supporting on the aerofoil in this configuration by virtue of the applied clamping force.

Figure 5A:
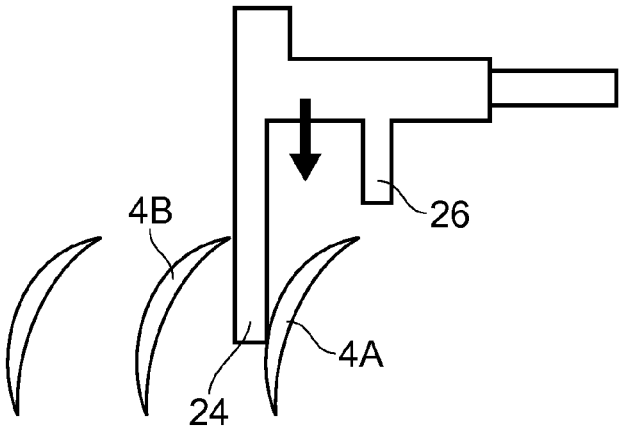
FIGS. 5A to 5*g* show the stages of an aerofoil removal process according to an example of the invention.
Figure 5B:
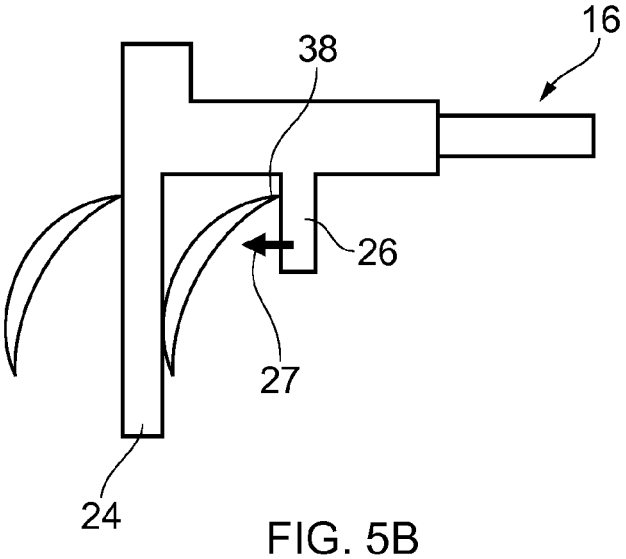
Figure 5C:
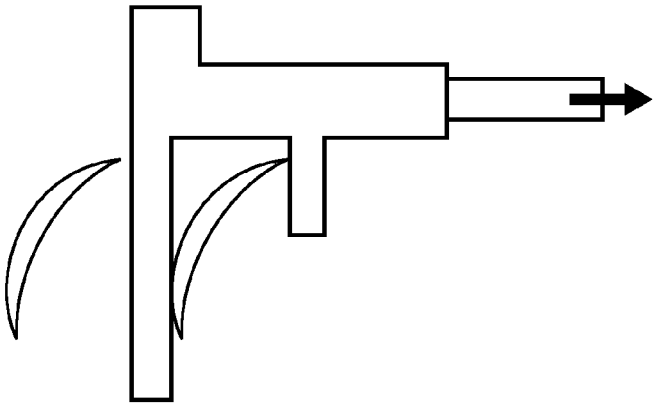

In the clamped condition, the tool can be manually articulated via handle 34. In particular, the user may first attempt to remove the aerofoil 12 from its position by grasping the first handle 34 and applying a pulling force as shown in FIG. 5C.

Figure 5D:
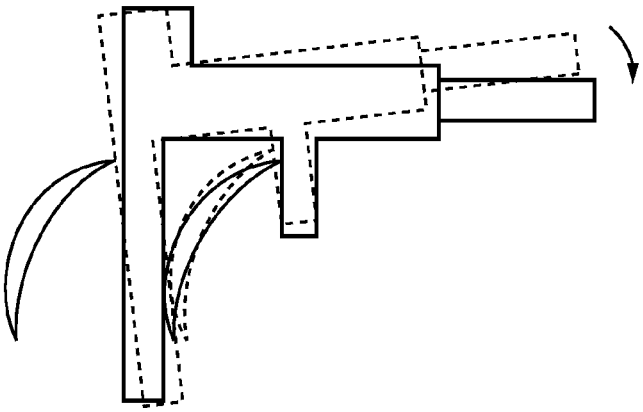

In order to facilitate the removal of the aerofoil 4A, if a simple pulling action is insufficient, the user can then attempt to lever the tool via the handle 34 so as to dislodge the aerofoil 4A from the array as shown in FIG. 5D. The overhang of the proximal end 20 provides a suitable levering arm. Due to the handle configuration, the user can also attempt to pull the tool whilst applying a levering action.

The levering action is a rotation of the tool about a longitudinal axis of the aerofoil, for example, about an axis parallel with the width dimension of the tool 16, or a radial direction for a circumferential aerofoil array. The tool in this configuration is also beneficially levered against the adjacent aerofoil 4B such that the levering force applied is not entirely dependent on the clamping force applied between the first and second jaw members.

Figure 5E:
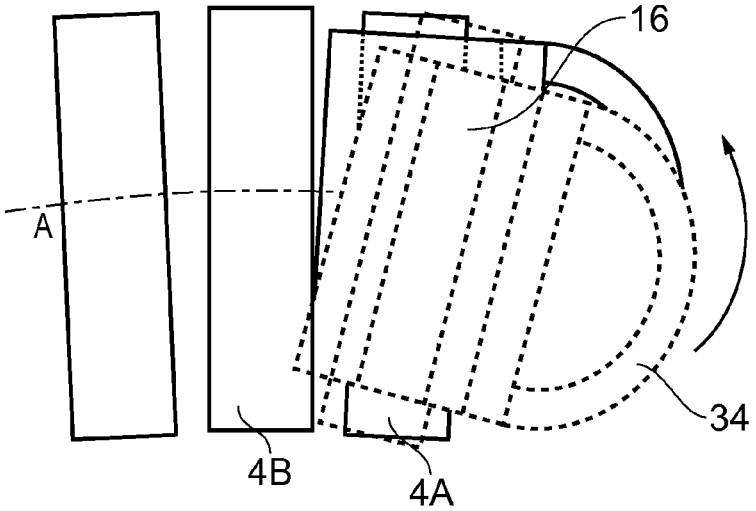

Additionally or alternatively, the tool may be manipulated to apply torque to the aerofoil about a further axis as shown in FIG. 5E, for example, in a twisting action, whereby the aerofoil is rotated about a point substantially mid-way along the aerofoil span. The axis of rotation is thus substantially perpendicular to the longitudinal axis of the aerofoil or the width direction of the tool. The form of the handle 34 is again useful for applying a force of this kind.

The above-described levering actions can dislodge a vane or other aerofoil that may have become jammed in its mounting in use with minimal likelihood of damaging the aerofoil or causing danger to the user.

Figure 5F:
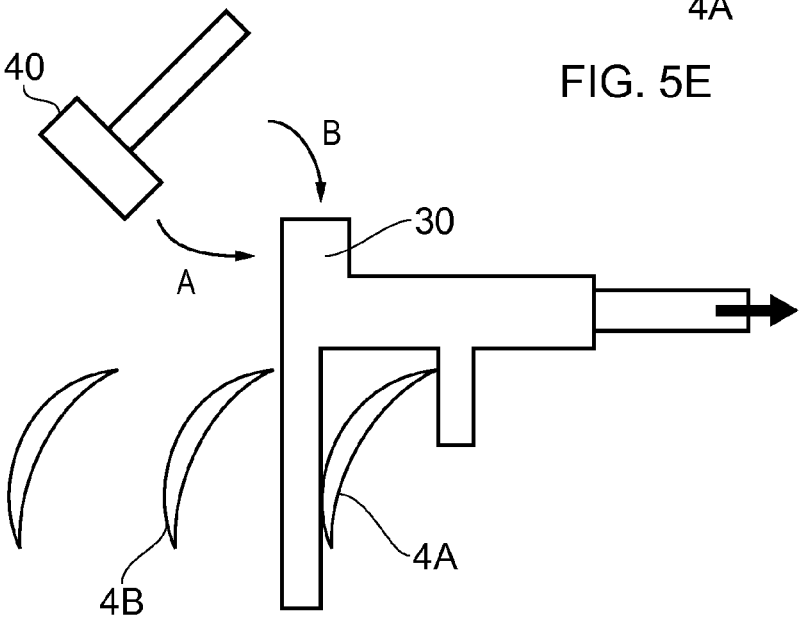

However in the event that the above steps are insufficient to dislodge the aerofoil 4A, then the user may apply an impact force using a conventional hand-held tool such as a hammer or mallet 40 as shown in FIG. 5F. The mallet 30 may be used to strike the impact formation 30 in one or more of predetermined directions A or B, typically in the vicinity of the distal end 22 of the tool body. Such impact forces can be applied whilst holding the handle 34 and/or pulling the tool away from the aerofoil 4B.

The uniform nature of the first jaw 24 and tool body portion 18 provides good transfer of the impact force and/or vibrations to the aerofoil 4A. Impacts can be repeated as many times as necessary. In the example shown, the impact is made to the impact formation from the distal end of the tool. This serves to dislodge the aerofoil 4A in the direction of removal from the array and/or associated casing structure.

If the aerofoil remains stuck fast after hammering, any of the above steps for manipulating the tool via handle 34 can be repeated whilst also impacting the tool in order to dislodge the aerofoil.

Figure 5G:
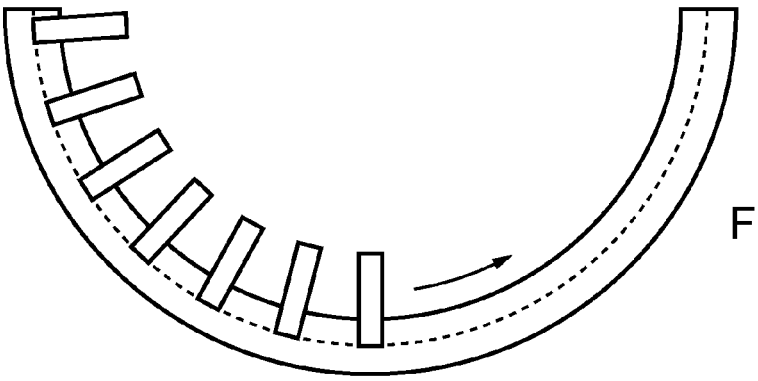

Once dislodged, the aerofoil 4A can be slid from the casing structure in the direction of removal C as shown in FIGS. 5F and 5G, for example, away from the remainder of the aerofoils in the array.

The steps described above for removal of aerofoil 4A may be repeated for the removal of each aerofoil in turn from the array of aerofoils. The method is particularly advantageous in that it allows manual intervention in the removal of aerofoils (for example, to accommodate different forces that may be required to remove each different aerofoil from the array) whilst still providing a standardised and simple process that can be followed to ensure the mechanical integrity of the aerofoils is not jeopardised. The force feedback offered by the tool is unlike fully automated processes and allows a fitter to ascertain which steps are relevant to undertake in each given scenario.

Accordingly, any combination of the method steps in sequence as described above may provide a definition of a method according to the invention.

The tool and aerofoil removal process is described above with reference to a gas turbine engine stator vane array. However it will be appreciated based upon the above description that the tool may be adapted for use with a number of other types of aerofoil array where it is desirous to remove aerofoils either individually or in small numbers from an aerofoil array that is held by a common circumferential support structure. The tool offers a relatively low cost and versatile means for removing aerofoils that improves on conventional hand tools, without the requirement for costly and somewhat ineffective machinery.

The invention claimed is:

1. A handheld tool adapted to facilitate the removal of an aerofoil from an array of aerofoils for an axial flow machine, the tool comprising:

a body portion; and first and second jaw members depending from the body portion, wherein the first jaw member is shaped to be insertable between a first aerofoil and an adjacent aerofoil in the array so as to contact a first portion of the first aerofoil, and the second jaw member is adapted to contact a further portion of the first aerofoil, the position of at least one of the first jaw member and the second jaw member being adjustable to selectively grip the first aerofoil therebetween in use, the body portion comprises a handle spaced from the first and second jaw members, the handle being oriented to allow application of a tensile force in the body portion between the handle and the first jaw member, and the handle is a first handle and the tool comprises a second handle, the second handle being adjustable relative to the body protion for actuation of the first or second jaw member.

2. The handheld tool according to claim 1, wherein the first jaw member is provided towards a first end of the body portion and is fixed relative to the body portion, the position of the second jaw member being adjustable in a direction between the first end and an opposing end of the body portion.

3. The handheld tool according to claim 1, wherein the first jaw member has a height that is greater than or substantially equal to the chord length of the first aerofoil.

4. The handheld tool according to claim 1, wherein the second jaw member is shorter in height than the first jaw member.

5. The handheld tool according to claim 1, wherein the first jaw member and second jaw member are substantially parallel in orientation.

6. The handheld tool according to claim 1, wherein the second jaw member is moveable towards a pressure side of the first aerofoil and the further portion of the first aerofoil is an edge of the aerofoil.

7. The handheld tool according to claim 1, wherein the handle is attached to the body portion at two spaced locations and the handle extends in a direction that is substantially parallel to at least one of the direction of spacing and the direction of relative movement between the first and second jaw members.

8. The handheld tool according to claim 1, further comprising a releasable lock or latch for selectively fixing the relative spacing between the first and second jaw members.

9. The handheld tool according to claim 1, wherein the body portion extends from the first to the second jaw member and beyond the second jaw member in order to provide a lever formation for application of torque to an aerofoil maintained between the first and second jaw members.

10. The handheld tool according to claim 1, wherein the body portion comprises an upstanding impact formation for transfer of impact forces to at least one of the first and second jaw members in use.

11. The handheld tool according to claim 1, wherein any, any combination, or all of the body portion, the first jaw member and the second jaw member are formed of a polymer material.

12. A method of removing aerofoils from an array of aerofoils for an axial flow machine, the method comprising the steps of:

i. inserting a first jaw member of a handheld tool between a first aerofoil and an adjacent aerofoil in the array, such that the first jaw member contacts a first portion of the first aerofoil, and adapting a second jaw member to contact a further portion of the first aerofoil, the first and second jaw members depending from a body portion of the handheld tool;

ii. adjusting the position of at least one of the first jaw member and the second jaw member so as to selectively grip the first aerofoil between the first and second jaw members, wherein the body portion comprises a handle spaced from the first and second jaw members, and the handle is a first handle and the tool comprises a second handle, the second handle being adjustable relative to the body portion for actuation of the first or second jaw member; and iii. applying a tensile force in the body portion between the handle and the first jaw member in order to remove the first aerofoil from its position in the array.

13. The method according to claim 12, further comprising applying a torque force to the first aerofoil via the tool.

14. The method according to claim 12, further comprising impacting a portion of the tool to dislodge the first aerofoil from the array.

* * * * *